United States Patent [19]

Garcia

[11] Patent Number: 4,483,887

[45] Date of Patent: Nov. 20, 1984

[54] METAL PLATING IRON-CONTAINING SUBSTRATES

[75] Inventor: Silverio M. Garcia, Norman, Okla.

[73] Assignee: Capetrol International, Inc., Norman, Okla.

[21] Appl. No.: 581,873

[22] Filed: Feb. 21, 1984

[51] Int. Cl.[3] ..... B05D 1/18; B22F 7/00; C25D 3/46

[52] U.S. Cl. ..... 427/436; 204/45 R; 204/46 G; 204/49; 204/52 R; 204/51; 204/47; 106/1.22; 106/1.23; 106/1.24

[58] Field of Search ..... 106/1.18, 1.22, 1.23, 106/1.24; 427/346; 204/45 R, 46 G, 49, 52 R, 47, 51

[56] References Cited

U.S. PATENT DOCUMENTS 3,607,352 11/1968 Fedgen ..... 106/1.22
4,374,876 2/1983 Shazly ..... 106/1.23

*Primary Examiner*—Sam Silverberg

*Attorney, Agent, or Firm*—Glen M. Burdick

[57] ABSTRACT

An improved plating solution for metal plating iron-containing metallic substrates comprising from about 1 to about 35 weight percent of an aqueous solution containing metal ions to be deposited on the substrate, and from about 65 to about 99 weight percent of an aqueous acidic component having a pH value of less than about 1. The aqueous acidic component is produced by (a) admixing from about 45 to about 85 weight percent hydrochloric acid with from about 20 to about 55 weight percent phosphoric acid in a suitable vessel for an effective period of time to produce a substantially homogeneous acidic mixture; (b) admixing the homogeneous acidic mixture with an effective amount of water to provide an aqueous acidic mixture; and (c) admixing from about 2 to about 20 weight percent of a hydroxy carboxylic acid and from about 0 to about 20 weight percent of a dicarboxylic acid with the aqueous acidic mixture.

22 Claims, No Drawings

METAL PLATING IRON-CONTAINING SUBSTRATES

BACKGROUND OF THE INVENTION

1. Field of the Invention

The present invention relates to metal plating of substrates, and more particularly but not by way of limitation to an improved aqueous acidic plating solution for the metal plating of iron-containing substrates to alter the existing surface properties or dimensions of such substrates. In one aspect the present invention relates to an improved method for metal plating iron-containing substrates.

2. Discussion of the Prior Art

Numerous processes have heretofore been employed for depositing metallic coatings on a substrate to alter the existing surface properties or the dimensions of the substrate. Typical of such processes are the electroplating process, the electroless plating process and the displacement plating process.

The electroplating process consists of connecting the parts to be plated to the negative terminal of a direct-current source, another piece of metal to the positive terminal and immersing both in a solution containing ions of the metal to be deposited on the surface of the parts connected to the negative terminal. Generally, the metal connected to the positive terminal (i.e. the anode) is the same material that is to be plated on the parts connected to the negative terminal (i.e. the cathode). Thus, metal dissolves at the anode and is plated at the cathode.

Most plating solutions utilized in the electroplating process are of the aqueous type. However, there is limited use of fused salts or organic liquids as solvents. Non-aqueous solutions are employed for the deposition of metal with lower hydrogen over voltage, i.e. hydrogen rather than the metal is reduced at the cathode in the presence of water.

Electroless plating and placement plating are two other deposition processes that are closely related to electroplating. Displacement plating occurs when the metal deposited is more noble than the substrate and the substrate dissolves. The reaction ceases when the substrate is completely covered by a pore-free deposit.

The electroless plating process is a chemical reduction process which, once initiated, is autocatalytic. The process is similar to electroplating except that no outside current is needed. The metal ions are reduced by chemical agents in the plating solutions, and deposit on the substrate. Electroless plating has found application for depositing a metal on a metallic substrate which is an irregularly shaped object but requires a uniform coating. Thus, an advantage of electroless plating over plating with current (i.e. electroplating) is that a more uniform thickness of the coating can be obtained using the electroless process than can be achieved with the electroplating process, especially when the objects have an irregular shape of deeply recessed areas which are difficult to plate.

While each of the before-mentioned prior art processes have been widely used in the depositing of metallic coatings on a substrate to alter the existing surface properties and dimensions of the substrate, improvements are constantly being sought which will enable one to more readily carry out the desired plating process and provide a more controlled and uniform thickness of the surface coating. Further, it would be highly desirable if improved plating solutions could be formulated which are substantially non-toxic in nature, possess safe handling characteristics, and which can readily be disposed of without deleterious effects to the environment.

SUMMARY OF THE INVENTION

The present invention provides an improved plating solution for use in the metal plating of iron-containing metallic substrates. The plating solution, which may be used either for electroplating or electroless plating, comprises from about 1 to about 35 weight percent of an aqueous solution containing the metal ions to be deposited on the substrate, and from about 65 to about 99 weight percent of an aqueous acidic component having a pH value of less than about 1. The aqueous acidic component employed in the formulation of the plating solution is produced by a method comprising the steps of:

(a) mixing from about 45 to about 85 weight percent hydrochloric acid with from about 20 to about 55 weight percent phosphoric acid in a suitable vessel for an effective period of time to provide a substantially homogeneous acidic mixture;

(b) admixing the homogeneous acidic mixture with an effective amount of water to provide an aqueous acidic mixture; and (c) admixing from about 2 to about 20 weight percent of a hydroxy carboxylic acid and from about 0 to about 20 weight percent of a dicarboxylic acid with the aqueous acidic mixture.

An object of the present invention is to provide an improved method for metal plating a substrate.

Another object of the present invention, while achieving the above stated object, is to provide an improved plating solution which can be used and handled without substantial damage or risk of injury to the person utilizing the plating solution.

Another object of the present invention, while achieving the above stated objects, is to provide an improved acidic component for use in the formulation of plating solutions.

Other objects, advantages and features of the present invention will be apparent from the following detailed description when read in conjunction with the appended claims.

DESCRIPTION OF PREFERRED EMBODIMENTS

The present invention provides an improved plating solution for depositing metal ions on an iron-containing substrate. The plating solution comprises from about 1 to about 35 weight percent of an aqueous solution containing metal ions to be deposited on the substrate, and from about 65 to about 99 weight percent of an aqueous acidic component having a pH value of less than about 1. The aqueous acidic component of the plating solution, which is formed from selected inorganic and organic acids, possesses unique properties in that the aqueous acidic component has strong acidic properties (i.e. a pH value of less of about 0.49), and yet is substantially inert to healthy human skin so that contact of the aqueous acidic component with the user's skin does not result in severe burns to the skin of the user.

The composition of the aqueous solution containing metal ions to be deposited on the substrate can vary widely and will be dependent on the particular metal to be plated on the substrate. Because the plating solution is an aqueous solution care must be exercised in selecting water soluble compounds containing the desired metal ions so that the metal ions will go into the solution with the aqueous phase. Further, as in the prior art plating processes, one must often utilize a series of plating steps of various metals in order to achieve the desired metallic coating on the substrate.

Typical of the metals which can be plated on the iron-containing metallic substrate in accordance with the present invention are gold, silver, copper, nickel, rhodium, chromium and the like. Gold can be directly plated on copper, nickel and brass; whereas nickel must be plated on copper. Thus, when gold or silver plating an iron-containing substrate one must first plate the substrate with copper. When one desires to plate rhodium on the iron-containing substrate one should first copper plate the substrate followed by gold plating and silver plating before plating the article with rhodium.

The aqueous solution containing metal ions employed in the plating solutions of the present invention will be formulated so as to contain from about 1 to about 35 weight percent of the desired metal ions. As previously stated, because the plating solution is an aqueous solution, care must be exercised to ensure that the compounds incorporated into the aqueous medium forming the carrier of the metal ions of the plating solution are water soluble. Typical examples of compounds which can be employed to provide the desired concentration of metal ions in the aqueous metal solution containing the ions are copper sulfate, potassium gold cyanide, gold sulfide complexes, nickel sulfate, silver nitrate, stannous chloride, stannous sulfate, water soluble chromium containing salts and the like. Thus, the only limitations as to the aqueous component containing the metal ions of the plating solution of the present invention is that the metallic containing compound is water soluble, and that the metal ions present in the aqueous solution be capable of being deposited on the iron-containing substrate.

The second essential ingredient of the plating solution of the present invention is the aqueous acidic component having a pH value of less than about 1. The unique aqueous acidic component is prepared by a process where the ingredients are believed critical. The order of addition of the ingredients used in the formulation of the aqueous acidic component can be varied without substantially altering the properties of the aqueous acidic component. However, especially desirable results have been obtained when the aqueous acidic component is prepared in accordance with the following procedure.

The initial step in the preparation of the aqueous acidic component of the plating solutions of the present invention comprises admixing from about 45 to about 85 weight percent hydrochloric acid and from about 20 to about 55 weight percent phosphoric acid in a vessel for an effective period of time to provide a substantially homogeneous acidic mixture. Because strong fumes are emitted upon mixing the hydrochloric acid and the phosphoric acid, care should be exercised in the mixing of the two components to insure that the mixing step is carried out in a well ventilated area or hood. The time required to mix the hydrochloric acid and phosphoric acid so as to provide a substantially homogeneous acidic mixture can vary widely; and the mixing time or period will generally depend upon the rate of addition of the two components, amounts of the two components, the rate or speed of agitation and the like.

All mixing and storage containers employed in the production of the acidic compositions are desirably fabricated of a substance that is acid resistant, such as stainless steel, plastic, fiberglass, glass, and the like. It is also desirable that all containers used in the process of the present invention be provided with covers for safety reasons and to keep foreign materials out of the product, especially the container in which the hydrochloric acid and phosphoric acid are mixed.

The homogeneous acidic mixture formed from the hydrochloric acid and phosphoric acid is then admixed with an effective amount of water (preferably distilled water) to provide an aqueous acidic mixture. The amount of water employed in the formulation of the aqueous acidic mixture can vary widely, but is generally an amount sufficient to provide from about 70 to about 90 weight percent water in the aqeuous acidic mixture. The aqueous acidic mixture is thoroughly stirred to insure substantially complete dispersion of the homogeneous acid mixture of the hydrochloric acid and the phosphoric acid into the water and to provide a substantially uniform aqueous acidic mixture.

While maintaining agitation on the aqueous acidic mixture, from about 2 to about 20 weight percent of a hydroxy carboxylic acid and from 0 to about 20 weight percent of a dicarboxylic acid are admixed with the aqueous acidic mixture.

As indicated above, the hydroxy carboxylic acid is a critical ingredient in the formation of the aqueous acidic component of the plating solution; whereas the dicarboxylic acid is an optional ingredient. However, especially desirable results have been obtained when a dicarboxylic acid is used in the formulation of the aqueous acidic component. The amount of hydroxy carboxylic acid and dicarboxylic acid incorporated into the aqueous acid mixture of the hydrochloric acid and phosphoric acid can vary widely within the ranges set forth hereinabove. However, the optimum amounts of hydroxy carboxylic acid and dicarboxylic acid admixed with the aqueous acidic mixture are the amounts required to provide from about 2 to about 10 weight percent of the hydroxy carboxylic acid and from about 1 to about 10 weight percent of the dicarboxylic acid in the aqueous acidic component.

When the dicarboxylic acid is included in the formulation of the aqueous acidic component of the plating solution, the dicarboxylic acid is generally admixed into the aqueous acidic mixture along with the hydroxy carboxylic acid. The order of addition of the dicarboxylic acid and the hydroxy carboxylic acid is not critical, although desirable results have been obtained wherein the dicarboxylic acid is introduced into the aqueous acidic mixture after the addition of the hydroxy carboxylic acid.

Any suitable hydroxy carboxylic acid can be employed in the preparation of the aqueous acidic component of the plating solutions of the present invention. Typical of such hydroxy carboxylic acids are citric acid, tartaric acid, malic acid, and the like. However, especially desirable results have been obtained wherein the hydroxy carboxylic acid added to the aqueous acidic mixture is citric acid.

Any suitable dicarboxylic acid can be employed in the preparation of the aqueous acidic component of the plating solutions of the present invention. Typical of such dicarboxylic acids are oxalic acid, malonic acid, succinic acid, glutaric acid, adipic acid, and the like. However, when employing a dicarboxylic acid in the preparation of the aqueous acidic component, desirable results have been obtained when the dicarboxylic acid added to the aqueous acidic mixture is oxalic acid.

The aqueous acidic component so produced will desirably contain from about 70 to about 90 weight percent water, more desirably from about 75 to 80 percent water. Thus, depending upon the amount of hydroxy carboxylic acid and dicarboxylic acid added to the aqueous acidic mixture, as well as the amount of water initially added to the acidic mixture formed by the hydrochloric acid and the phosphoric acid, it may be desirable to further dilute the aqueous acidic component with an effective amount of water to insure that the concentration of water in the aqueous acidic component is from about 70 to about 90 weight percent, more desirably from about 75 to about 80 weight percent. In those instances where it is determined that the amount of water present in the aqueous acidic component is less than the specified amount, the aqueous acidic component is admixed with an effective amount of water so as to provide the aqueous acidic component of the plating solution with the desired amount of water.

The aqueous acidic component used in the plating solution of the present invention is a substantially colorless liquid having an appearance substantially similar to water. Further, the aqueous acidic component prepared as set forth hereinbefore, both with and without the incorporation of the dicarboxylic acid, has a pH value of less than 1 (i.e. about 0.49) and is substantially inert to healthy human skin.

The plating solution containing the aqueous solution of the metal ions to deposit on the substrate and the aqueous acidic component having a pH value of less than about 1 as set forth hereinbefore can be employed in any plating system, such as in an electroplating system, an electroless plating system, and a displacement plating system. However, especially desirable results have been obtained when the plating solution is employed in an electroless-type system. A process utilizing the improved plating solution of the present invention, in addition to being an energy saving process, appears to be less effected by the geometry of the substrate on which the metallic ions are to be plated than the electroplating system. However, it is to be understood that while the preferred method of carrying out the plating process is via the electroless-type process as will be described hereinafter, the plating solution defined above is not limited to such process.

The improved plating solution of the present invention may further contain an effective amount of a mineral acid, such as hydrochloric acid or sulfuric acid. The effective amount of the mineral acid incorporated into the plating solution can vary widely but is desirably incorporated in an amount sufficient to provide up to about 15 weight percent of the mineral acid in the plating composition. It should be noted that even when incorporating an effective amount of a mineral acid into the plating solution, such as from about 1 to about 15 weight hydrochloric acid into the aqueous plating solution, the resulting plating solution still possesses the desired safe-handling characteristics as the plating solution containing only the aqueous acidic component and the aqueous solution of metal ions heretofore described. Further, the three component plating solution (i.e. a plating solution containing the aqueous acidic component having a pH value of less than 1, aqueous solution of the metal ions, and the effective amount of a mineral acid) can be used as the plating solution in any known plating process.

In order for an adherent coating to be deposited on the iron-containing substrate using the unique plating solution of the present invention, the surface of the substrate must be chemically clean, that is, free from oils, greases, oxides and sulfides. Generally two essential steps have heretofore been employed in the initial preparation of the surface of the substrate to be plated, namely, cleaning (wherein oil, grease and attached solids are removed from the substrate) and pickling (wherein oxides are removed from the substrate).

The cleaning of the substrate has heretofore been accomplished by either solvent cleaning, emulsion cleaning, or electronic cleaning of the substrate. When cleaning the substrate using the solvent cleaning process, a solvent (i.e. tri- or tetrachloroethylene) is boiled in a closed system and the vapors are condensed on the substrate's surface to degrease the surface. In emulsion cleaning the substrate is immersed in a warm mixture of kerosene, a wetting agent and an alkaline solution. The electronic cleaning method involves immersing the substrate in an alkaline solution and passing a direct current between the substrate and another electrode, such as steel.

Once the substrate has been effectively cleaned to remove grease, oil and attached solids, the substrate is subjected to the pickling process so that oxides on the surface of the substrate are removed. The pickling system used will be dependent to a large degree upon the composition of the substrate. For example, when steel is the substrate a warm, dilute sulfuric acid solution may be employed as the pickling solution, or a room temperature, dilute hydrochloric acid solution may also be employed. However, care must be exercised during the pickling, and even in certain plating operations, to insure that hydrogen does not diffuse into the substrate during the treatment phase of the substrate and cause hydrogen embrittlement of the substrate.

While the above cleaning and pickling processes have met with considerable success in providing a chemically clean surface on the substrate to be plated, it has unexpectantly been determined that solid deposits on an iron-containing substrate, such as oxides, can be removed to provide a substantially, chemically clean surface for plating of metallic ions thereon using as a combination cleaning and pickling solution the aqueous acidic component having a pH value of less than about 1 employed in the formulation of the plating solution, or an amine-containing aqueous acidic component having a pH value of less than about 1. The preparation of the aqueous acidic component employed in the formulation of the plating solution has heretofore been described in detail. Thus, the process for preparing the aqueous acidic component, even when used as a combination cleaning and pickling solution for iron-containing substrates will not be reiterated as such would be merely repetition. The amine-containing aqueous acidic component having a pH value of less than about 1 which can also be used as the cleaning and pickling solution for the removal of solid materials, such as oxides, from an iron-containing substrate, is prepared substantially in the same manner using the same constituents as the aqueous acidic component having a pH value of less than about 1 of the plating solution heretofore described in detail, with the exception that an effective minor amount of a polyamine is admixed with the aqueous acidic component to provide the amine-containing aqueous acidic component.

The effective minor amount of the polyamine incorporated into the aqueous acidic component (i.e. the aqueous acidic component used in the formulation of the plating solution) to form the amine-containing solution employed as a combination cleaning and pickling solution for the removal of solid materials from an iron-containing substrate can vary widely, but will generally range from about 1 to about 5 weight percent. Further, any suitable polyamine compatible with the aqueous acidic component can be employed. Typical of such polyamines are hexamethylenetetramine, hexamethylenediamine, hexamethyleneamine and the like. However, desirable results have been obtained where the polyamine is hexamethylenetetramine, and the hexamethylenetetramine is incorporated into the aqueous acidic component in an amount to provide from about 2 to about 3 weight percent of the polyamine in the amine-containing solution employed as the combination cleaning and pickling solution.

When employing the aqueous acidic component or the aqueous acidic amine-containing solution as the combination cleaning and pickling solution for an iron-containing substrate to remove solid materials therefrom, such as oxides, it may be desirable to admix an effective amount of an inorganic acid, such as hydrochloric acid or sulfuric acid with the aqueous acidic component or the aqueous amine-containing solution to enhance the removal of the solid materials from the iron-containing substrate. When employing an inorganic acid in combination with either the aqueous acidic component or the aqueous amine-containing solution the amount of the inorganic acid employed can vary widely and will be dependent to a large degree upon the amount of solid materials required to be removed from the substrate. However, desirable results can be obtained when from about 35 to about 65 weight percent of the inorganic acid is admixed with from about 35 to about 65 weight percent of either the aqueous acidic component or the aqueous amine-containing solution to form the cleaning and pickling agent for the iron-containing substrate prior to plating of same.

While either the aqueous acidic component or the aqueous amine-containing solution, either per se or in combination with an inorganic acid, can be employed as a combination cleaning and pickling solution in the preparation of an iron-containing substrate for a plating process, it is more desirable that when employing such solution that one use as such a solution the aqueous acidic component or a mixture of an inorganic acid and the aqueous acidic component because the aqueous amine-containing solution has a tendency to put a protective coating on the substrate which must be rinsed from the clean substrate prior to the substrate being immersed into the plating solution. However, when employing the aqueous acidic component as the combination cleaning and pickling solution the rinsing step can be ommitted.

As previously stated, when employing the aqueous acidic component as the combination cleaning and pickling solution as the iron-containing substrate for the removal of solid materials therefrom (either per se or in combination with a mineral acid such as hydrochloric acid) one can immediately remove the cleaned substrate from the solution and place same in the plating solution and achieve an adherent uniform coating of the metal ions in the plating solution on the cleaned substrate. However, one may, if desired, rinse and dry the cleaned substrate prior to immersion of the substrate into the plating solution. On the other hand, when employing the aqueous amine-containing solution, either per se or in combination with a mineral acid, it is desirable that the cleaned substrate be rinsed and dried prior to immersion of the substrate into the plating solution.

Any suitable inert solution can be employed to rinse the cleaned substrate. Typical of such inert solutions are distilled water, isopropanol and the like. Further, the drying of the rinsed cleaned substrate can be accomplished using oil free towels, air or by placement of the cleaned substrate in an oven.

It should be noted that the aqueous acidic component and the aqueous amine-containing solution, either per se or in combination with an inorganic acid, are not formulated to remove grease and oils from the substrate, but only for the removal of solid materials, such as oxides therefrom. Thus, if the iron-containing substrate contains grease or oil in addition to solid materials, one should desirably contact the substrate with a proper cleaning solution to remove the oils and greases therefrom, such as those heretofore described.

Once the metallic substrate has been cleaned of foreign deposits and is provided with a substantially chemically clean surface, the metallic substrate is immersed into the aqueous plating solution for a period of time effective to allow the metal ions in the plating solution to be deposited on the surface of the substrate. Once a substantially uniform coating of the metal ions has been deposited on the substrate, the substrate is withdrawn from the solution and allowed to dry. In certain instances it may be desirable to rinse the plated substrate with a liquid, such as water, prior to allowing same to dry.

The period of time the substrate is contacted with the plating solution can vary widely and will be dependent to a large degree upon the concentration of metal ions in the plating solution, the type of metal ions in the plating solution and the thickness of the deposit of the metal ions to be formed on the metallic substrate. However, generally a substantially uniform plating of the metallic ions can be accomplished on the metal substrate within a period of time of from about 10 seconds to about 1 minute.

The improved plating solution set forth above, and the method for plating an iron-containing substrate employing the plating solution, and each component thereof is preferably formulated using distilled water. However, it has unexpectantly been found that contrary to established plating procedures, the components of the plating solution and thus the plating solution can be formulated using ordinary tap water. This is surprising in that the minerals contained in tap water do not appear to adversely affect the metallic deposit formed on the iron substrate from the plating solution. However, because of the wide degree of variance in tap waters throughout the United States and the world, it is believed that a more uniform and consistent coating can be achieved when each of the components is formulated using distilled water.

In order to more fully describe the present invention the following examples are set forth. However, it is to be understood that the examples are for illustrative purposes and are not to be construed as limiting the scope of the present invention as defined in the appended claims.

EXAMPLE I

Preparation of Aqueous Acidic Component 3.6 pounds of hydrochloric acid and 2.1 pounds of phosphoric acid were added to a container and the acids were stirred to produce a substantially homogeneous acidic mixture. During the mixing of the hydrochloric acid and the phosphoric acid fumes were generated. Thus, the mixing of the hydrochloric acid and the phosphoric acid was carried out in a ventilated area.

16.6 pounds of clean water was then placed into a second container. 5.6 pounds of the hydrochloric-phosphoric mixture was added to the water in the second container. The resulting aqueous acidic solution was mixed thoroughly. Thereafter, 1.1 pounds of powdered citric acid and 0.8 pounds of powdered oxalic acid were admixed into the aqueous acidic mixture to produce an aqueous acidic composition.

The aqueous acidic composition was then diluted by admixing 24.1 pounds of the aqueous acidic composition with 16.6 pounds of clean water in a third container. The aqueous acidic composition and water were thoroughly stirred and provided approximately five gallons of an aqueous acidic component having a pH value of about 0.49.

The mixing and storage containers employed were formed of materials substantially acid resistant. Further, all containers were covered for safety reasons and to prevent foreign materials from being injected into the aqueous acidic component.

EXAMPLE II

Preparation of an Amine-Containing Aqueous Acidic Component

In the preparation of an amine-containing aqueous acidic component the same steps and procedures set forth in Example I for the preparation of the aqueous acidic component were carried out. Following the dilution of the aqueous acidic component described above, 0.8 pounds of hexamethylenetetramine was admixed into about 40.7 pounds of the aqueous acidic component and admixing continued until a substantially homogeneous colorless liquid was formed. Approximately five gallons of the amine-containing aqueous acidic component was formed using the procedure, and the amine-containing aqueous acidic component had a pH value of about 0.91.

As in the preparation of the aqueous acidic component of Example I, all mixing and storage containers employed were acid resistant containers. Further, each of the containers was covered for safety reasons and to prevent foreign materials from being introduced into the product.

EXAMPLE III 200 milliliters of the aqueous acidic component prepared in accordance with Example I was admixed with 200 milliliters of hydrochloric acid in a beaker. A bolt having a heavy oxide coating (i.e. rust) was submerged in the solution so formed for 15 minutes. The bolt was then removed and examined. Substantially all rust and other foreign materials were removed from the surface of the bolt leaving a clean, solid iron-containing substrate.

100 milliliters of the aqueous acidic component prepared in accordance with Example I was placed in a second beaker together with 50 milliliters of an aqueous solution saturated with copper sulfate. The resulting admixture was stirred thoroughly and the bolt cleaned in accordance with the procedure set forth above was placed in the solution. After 20 minutes the bolt was removed from the plating solution and examined. Upon examination of the bolt it was determined that a copper plating had taken place on the portion of the bolt that was in contact with the plating solution.

EXAMPLE IV

A portion of the amine-containing aqueous acidic component prepared in accordance with Example II was placed in a beaker. Thereafter, a bolt having an oxide coating (i.e. rust) was submerged in the amine-containing aqueous acidic component for approximately one hour. After one hour the bolt was removed from the amine-containing aqueous acidic component and placed in a plating solution containing 50 milliliters of the aqueous acidic component prepared in accordance with Example I and 30 milliliters of an aqueous solution saturated with copper sulfate. The plating solution was mixed thoroughly prior to submersion of a portion of the bolt in the plating solution.

After 20 minutes the bolt was removed from the plating solution and examined. It was determined that a copper plating had taken place on the portion of the bolt submerged in the plating solution, although the copper plating appeared to be inferior to the plating resulting from the procedure set forth in Example III. It is believed that the amine in the amine-containing aqueous acidic component functions as an inhibitor to pacivate the surface of the metal and thus slow down the plating process. Therefore, it is believed that when employing the amine-containing aqueous acidic component as the cleaning solution one should first rinse and dry the clean component with water to remove any residual amine on the surface of the metal.

The aqueous acidic component, the amine-containing aqueous acidic component and mixtures of such components with a mineral acid, such as HCl, enable one to readily clean oxides, such as rust, from iron-containing substrates. Further, the aqueous acidic component appears to activate the surface and enhances plating of metallic ions from the plating solution to which it is exposed. Thus, it is clear that the present invention is well adapted to carry out the objects and attain the ends and advantages mentioned herein as well as those inherent in the invention. While presently preferred embodiments of the invention have been described for the purposes of this disclosure, numerous changes may be made which will readily suggest themselves to those skilled in the art and which are accomplished within the spirit of the invention disclosed and as defined in the appended claims.

What is claimed is:

1. An improved plating solution for depositing metal ions on an iron-containing substrate, the plating solution comprising:

(a) from about 1 to about 35 weight percent of an aqueous solution containing the metal ions to be deposited on the substrate; and (b) from about 65 to about 99 weight percent of an aqueous acidic component having a pH value of less than about 1, the aqueous acidic component prepared by the steps of:

(1) admixing from about 45 to about 80 weight percent hydrochloric acid with from about 20 to about 55 weight percent phosphoric acid to produce an acidic mixture;

(2) admixing the acidic mixture with an effective amount of water to produce an aqueous acidic mixture; and (3) admixing from about 2 to about 20 weight percent of a hydroxy carboxylic acid and from about 0 to about 20 weight percent of a dicarboxylic acid into the aqueous acidic mixture.

2. The improved plating solution for depositing metal ions on an iron-containing substrate of claim 1 wherein the plating solution further comprises from about 1 to about 15 weight percent of a mineral acid selected from the group consisting of hydrochloric acid and sulfuric acid.

3. The improved plating solution of claim 2 wherein the preparation of the aqueous acidic component further comprises admixing an effective amount of water with the aqueous acidic component so as to provide from about 70 to about 90 weight percent water in the aqueous acidic component.

4. The improved plating solution of claim 2 wherein the aqueous acidic component contains at least about 1 weight percent of the dicarboxylic acid, and the preparation of the aqueous acidic component further comprises admixing an effective amount of water with the aqueous acidic component to provide from about 70 to about 90 weight percent water in the aqueous acidic component.

5. The improved plating solution of claim 4 wherein the hydroxy carboxylic acid is present in the aqueous acidic component in an amount of from about 2 to about 10 weight percent and the dicarboxylic acid is present in the aqueous acidic mixture in an amount of from about 1 to about 10 weight percent.

6. The improved plating solution of claim 5 wherein the hydroxy carboxylic acid is citric acid and the dicarboxylic acid is oxalic acid.

7. The improved plating solution of claim 6 wherein the aqueous solution containing the metal ions is an aqueous solution substantially saturated with the metal ions.

8. An improved process for depositing metallic ions on a metallic substrate comprising:

(a) immersing at least a portion of a metallic substrate having a substantially chemically clean surface into an aqueous plating solution containing metal ions for a period of time effective to form a deposit of the metal ions on the metallic substrate, the aqueous plating solution characterized as consisting essentially of from 0 to about 15 weight percent of a mineral acid, from about 1 to about 35 of an aqueous solution containing selected metal ions to be deposited on the substrate, and from about 65 to about 99 weight percent of an aqueous acidic component having a pH value of less than 1, the aqueous acidic component prepared by the steps of:

(1) admixing from about 45 to about 80 weight percent hydrochloric acid with from about 20 to about 55 weight percent phosphoric acid to produce an acidic mixture;

(2) admixing the acidic mixture with an effective amount of water to produce an aqueous acidic mixture; and (3) admixing from about 2 to about 20 weight percent of a hydroxy carboxylic acid and from about 0 to about 20 weight percent of a dicarboxylic acid into the aqueous acidic mixture; and (b) withdrawing the substrate from the aqueous plating solution and recovering a plated metal substrate.

9. The improved processes for depositing metallic ions on a metallic substrate further comprising:

cleaning at least the portion of the metal substrate to provide a substantially chemically clean surface prior to immersing the substrate in the aqueous plating solution.

10. The improved process for depositing metallic ions on a metallic substrate of claim 9 wherein the cleaning of the metallic substrate comprises immersing the metal substrate in an effective amount of the aqueous acidic component having a pH value of less than about 1 for a period of time effective to remove foreign deposits from the substrate and provide a substantially chemically clean surface on the substrate.

11. The improved process for depositing metallic ions on a metallic substrate of claim 10 further comprising:

withdrawing the metallic substrate from contact with the aqueous acidic component;

rinsing the cleaned metallic substrate with a liquid component to remove residual aqueous acidic component from the cleaned substrate; and drying the rinsed metallic substrate prior to immersion of same in the plating solution.

12. The improved process for depositing metallic ions on a metallic substrate of claim 9 wherein the cleaning of the metallic substrate comprises immersing the metal substrate in an aqueous acidic cleaning mixture containing from about 35 to about 65 weight percent of a mineral acid and from about 35 to about 65 weight percent of the aqueous acidic component having a pH value of less than about 1 employed in the formulation of the plating solution.

13. The improved process for depositing metallic ions on a metallic substrate of claim 12 wherein the mineral acid of the aqueous acidic cleaning mixture is HCl.

14. The improved process for depositing metallic ions on a metallic substrate of claim 13 further comprising:

withdrawing the metallic substrate from contact with the aqueous acidic cleaning mixture;

rinsing the cleaned metallic substrate with a liquid component to remove residual aqueous acidic cleaning mixture from the cleaned substrate; and drying the rinsed metallic substrate prior to immersion of same in the plating solution.

15. The improved process for depositing metallic ions on a metallic substrate of claim 14 where the liquid component employed to rinse the cleaned metal substrate is selected from the group consisting of water and isopropanol.

16. The improved process for depositing metallic ions on a metal substrate of claim 9 wherein the cleaning of the metallic substrate is accomplished by contacting the substrate with an amine-containing aqueous acidic component having a pH value of less than about 1 for a period of time to remove substantially all of the foreign materials from the substrate and provide the substrate with a substantially chemically clean surface, the amine-containing aqueous acidic component prepared by the steps of:

mixing from about 45 to about 80 weight percent hydrochloric acid with from about 20 to about 55 weight percent phosphoric acid to produce a substantially homogeneous acidic mixture;

admixing the acidic mixture with an effective amount of water to provide an aqueous acidic mixture;

admixing from about 2 to about 20 weight percent of a hydroxy carboxylic acid and from 0 to about 20 weight percent of a dicarboxylic acid with the aqueous acidic mixture to produce a hydroxy carboxylic acid containing aqueous acidic mixture; and admixing from about 1 to about 5 weight percent of a polyamine with the hydroxy carboxylic acid containing aqueous acidic mixture.

17. The improved process for depositing metallic ions on a metallic substrate of claim 16 further comprising:

withdrawing the metallic substrate from contact with the amine-containing aqueous acidic component;

rinsing the cleaned metallic substrate with a liquid component to remove residual amine-containing aqueous acidic component from the cleaned substrate; and drying the rinsed metallic substrate prior to immersion of same in the plating solution.

18. The improved process for depositing metallic ions on a metal substrate of claim 9 wherein the cleaning of the metallic substrate is accomplished by contacting the substrate with an aqueous acidic cleaning mixture comprising from about 35 to about 65 weight percent of a mineral acid and from about 35 to about 65 weight percent of an amine-containing aqueous acidic component having a pH value of less than about 1, the amine-containing aqueous acidic component prepared by the steps of:

mixing from about 45 to about 80 weight percent hydrochloric acid with from about 20 to about 55 weight percent phosphoric acid to produce a substantially homogeneous acidic mixture;

admixing the acidic mixture with an effective amount of water to provide an aqueous acidic mixture;

admixing from about 2 to about 20 weight percent of a hydroxy carboxylic acid and from 0 to about 20 weight percent of a dicarboxylic acid with the aqueous acidic mixture to produce a hydroxy carboxylic acid containing aqueous acidic mixture; and admixing from about 1 to about 5 weight percent of a polyamine with the hydroxy carboxylic acid containing aqueous acidic mixture.

19. The improved process for depositing metallic ions on a metal substrate of claim 18 further comprising:

withdrawing the metallic substrate from contact with the aqueous acidic cleaning mixture;

rinsing the cleaned metallic substrate with a liquid component to remove residual aqueous acidic cleaning mixture from the cleaned substrate; and drying the rinsed metallic substrate prior to immersion of same in the plating solution.

20. The improved process for depositing metallic ions on a metal substrate of claim 19 where the liquid component employed to rinse the cleaned metal substrate is selected from the group consisting of water and isopropanol.

21. The improved process for depositing metallic ions on a metal substrate of claim 20 wherein the inorganic acid employed in the aqueous acidic cleaning mixture is HCl.

22. The improved process for depositing metallic ions on a metal substrate of claim 21 wherein the liquid component employed to rinse the cleaned metal substrate is water.

* * * * *